US009557664B2

(12) United States Patent
Ishiduka et al.

(10) Patent No.: US 9,557,664 B2
(45) Date of Patent: Jan. 31, 2017

(54) ELECTROPHOTOGRAPHIC PHOTOSENSITIVE MEMBER, METHOD FOR MANUFACTURING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Yuka Ishiduka, Suntou-gun (JP); Ryoichi Tokimitsu, Kashiwa (JP); Wataru Kitamura, Abiko (JP); Mai Murakami, Kashiwa (JP); Kan Tanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/784,533

(22) PCT Filed: Mar. 27, 2014

(86) PCT No.: PCT/JP2014/059792
§ 371 (c)(1),
(2) Date: Oct. 14, 2015

(87) PCT Pub. No.: WO2014/171338
PCT Pub. Date: Oct. 23, 2014

(65) Prior Publication Data

US 2016/0077452 A1 Mar. 17, 2016

(30) Foreign Application Priority Data

Apr. 16, 2013 (JP) ..... 2013-086148

(51) Int. Cl.
*G03G 5/00* (2006.01)
*G03G 5/14* (2006.01)
*G03G 5/04* (2006.01)

(52) U.S. Cl.
CPC ..... *G03G 5/144* (2013.01); *G03G 5/04* (2013.01); *G03G 5/142* (2013.01)

(58) Field of Classification Search
CPC ..... G03G 5/142; G03G 5/144
(Continued)

(56) References Cited

U.S. PATENT DOCUMENTS 4,869,986 A 9/1989 Riblett

FOREIGN PATENT DOCUMENTS

JP 63-73266 A 4/1988
JP 4-356055 A 12/1992
(Continued)

*Primary Examiner* — Mark A Chapman
(74) *Attorney, Agent, or Firm* — Canon U.S.A., Inc., IP Division

(57) ABSTRACT

The present invention provides an electrophotographic photosensitive member which includes an undercoat layer, and the undercoat layer contains metal oxide particles and a compound represented by the formula (1).

(1)

14 Claims, 1 Drawing Sheet

(58) Field of Classification Search
USPC ..... 430/60, 61, 62, 63, 64, 65
See application file for complete search history.

(56) References Cited

FOREIGN PATENT DOCUMENTS

| | | | |
|---|---|---|---|
| JP | 9-218546 | A | 8/1997 |
| JP | 11-109666 | A | 4/1999 |
| JP | 2003-162079 | A | 6/2003 |
| JP | 2008-046420 | A | 2/2008 |

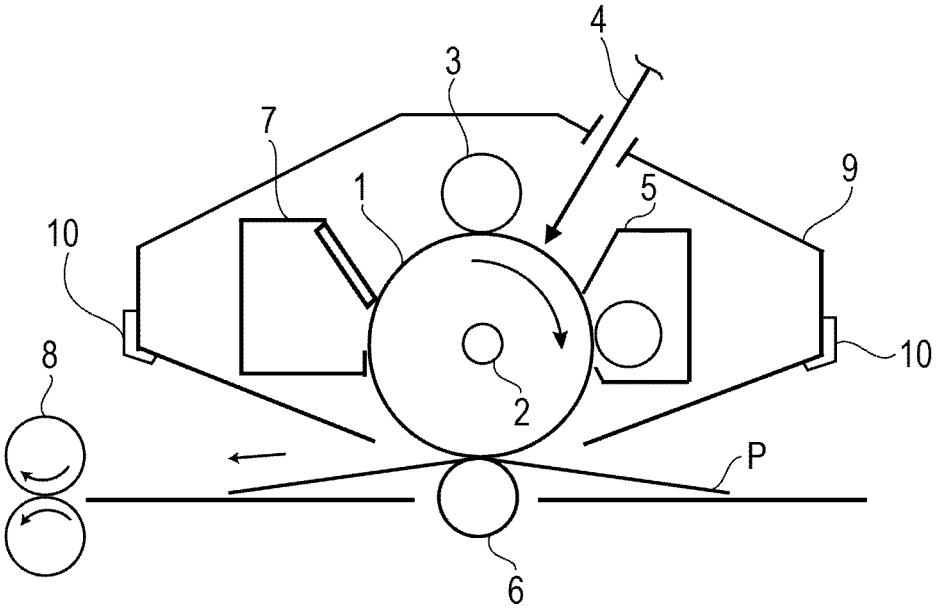
4
3
7
9
1
5
10
10
8
2
P
6

ELECTROPHOTOGRAPHIC PHOTOSENSITIVE MEMBER, METHOD FOR MANUFACTURING THE SAME, PROCESS CARTRIDGE, AND ELECTROPHOTOGRAPHIC APPARATUS

TECHNICAL FIELD

The present invention relates to an electrophotographic photosensitive member, a method for manufacturing the same, a process cartridge, and an electrophotographic apparatus.

BACKGROUND ART

In recent years, as an electrophotographic photosensitive member used in an electrophotographic apparatus, there has been used an electrophotographic photosensitive member (organic electrophotographic photosensitive member) including an undercoat layer which contains metal oxide particles and an organic compound and a photosensitive layer which is provided on the undercoat layer and which contains a charge generation substance and a charge transport substance.

Potential characteristics (charging property and sensitivity) of the electrophotographic photosensitive member depend on types of materials used for the undercoat layer and the photosensitive layer. In particular, the metal oxide particles and the organic compound used for the undercoat layer are materials which have significant influences on the potential characteristics of the electrophotographic photosensitive member. Accordingly, it has been known that by the structures of the above materials and the combination therebetween, the potential characteristics of the electrophotographic photosensitive member can be improved.

In concomitant with an increase in speed (increase in process speed) of the electrophotographic apparatus, besides improvement in potential characteristics, such as improvement in charging property and improvement in sensitivity, further suppression of the change in potential (change in charging property, and change in sensitivity) during a repetitive use also becomes a subject to be overcome. In particular, the metal oxide particles have a problem in that the change in potential is increased during a repetitive use under a high-temperature and high-humidity environment. The reason for this is believed that the flow of electrical charge is suppressed when the metal oxide particles absorb moisture, and as a result, the potential is changed. Hence, it is necessary to suppress the change in potential by suppression of moisture absorption.

PTL 1 has disclosed that when metal oxide particles and an organic compound having an anthraquinone structure are used for an undercoat layer, the amount of change in residual potential after discharging in a repetitive image formation test under a high-temperature and high-humidity environment can be suppressed.

CITATION LIST

Patent Literature

PTL 1 Japanese Patent Laid-Open No. 2008-046420

SUMMARY OF INVENTION

Technical Problem

In a method for using an electrophotographic apparatus described below, the change in potential under a high-temperature and high-humidity environment is particularly a problem. In particular, further suppression of the change in potential (change in charging property and change in sensitivity) in the cases of the following (1) and (2) becomes a subject to be overcome.

(1) A long-term repetitive use from the start of use of an electrophotographic photosensitive member to the end of life thereof.

(2) A repetitive use for a relatively short period of time (for example, a period of continuous image output from the first sheet to an approximately 1,000th sheet).

In the case of the above (1), the change in potential may be increased (remarkable degradation in potential characteristics) in some cases depending on the configuration of the electrophotographic photosensitive member. In the case as described above, even when the electrophotographic photosensitive member is left to stand after the long-term repetitive use, the potential characteristics at the start of use may not be recovered, and hence, it can be said that the recovery performance is inferior.

On the other hand, when the change in potential is large in the case of the above (2), for example, a color tone of an image output on the 1,000th sheet may be changed from that of an image output on the first sheet in some cases. However, when the electrophotographic photosensitive member is left to stand, the change in potential which occurs in a short period of time as described above is likely to be recovered to the potential characteristics at the start of use within a relatively short period of time.

In addition, it has been construed that in the case of the above (2), even after the electrophotographic photosensitive member is left to stand, if there is still a change in potential which cannot be recovered in a short period of time, this change may be accumulated to cause the change in potential in the above (1).

It is important for the electrophotographic photosensitive member to be able to always output a stable image while the change in potential is suppressed in the cases of the above (1) and (2). In addition, in particular, the change in potential in the case of the above (2) is the problem, and the change in color tone is always required to be small under any conditions.

That is, the change in potential of the electrophotographic photosensitive member in the above (2) is required to be suppressed at a very early stage of the use thereof, and the change in potential of the electrophotographic photosensitive member in the above (2) is also required to be suppressed even after the long-term repetitive use thereof.

Through intensive research carried out by the present inventors, it was found that when the electrophotographic photosensitive member disclosed in PTL 1 is used for a short period of time at a very early stage of the use thereof under a high-temperature and high-humidity environment, the change in potential (in the above (2)) is small. However, by research on the change in potential (in the above (2)) obtained when the electrophotographic photosensitive member is again used for a short period of time after the long-term repetitive use thereof (the above (1)), it was found that the amount of the change in potential becomes larger than that measured at the early stage in some cases, and that the electrophotographic photosensitive member still has some more room for improvement.

In addition, it also became apparent that even when the amount of the change in potential in the above (1) or (2) is small under a low-temperature and low-humidity environment, the amount of the change in potential may be increased in some cases under a high-temperature and high-humidity environment, and hence it was found that the electrophotographic photosensitive member still has some more room for improvement.

The present invention provides an electrophotographic photosensitive member which suppresses the change in potential when used for a short period of time even after a long-term repetitive use thereof under a high-temperature and high-humidity environment and a manufacturing method of the electrophotographic photosensitive member. In addition, the present invention also provides a process cartridge and an electrophotographic apparatus, each of which includes the above electrophotographic photosensitive member.

Solution to Problem

The present invention relates to an electrophotographic photosensitive member including: a support; an undercoat layer provided on the support; and a photosensitive layer provided on the undercoat layer, and the undercoat layer contains metal oxide particles and a compound represented by the following formula (1).

(1)

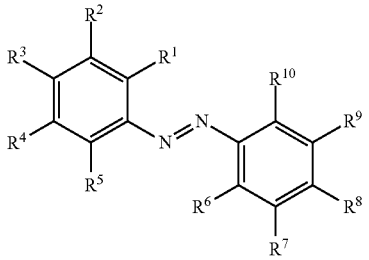

(In the formula (1), $R^1$ to $R^{10}$ each independently represents a hydrogen atom, a methyl group, an ethyl group, a n-propyl group, an isopropyl group, a cyclohexyl group, a carboxyl group, a hydroxy group, or an atomic group necessary for forming a cyclohexane ring together with $R^n$ and $R^{n+1}$. At least one of $R^1$ to $R^{10}$ is a carboxyl group or a hydroxy group. In addition, n represents an integer from 1 to 9.)

In addition, the present invention relates to a method for manufacturing an electrophotographic photosensitive member which includes a support, an undercoat layer formed on the support, and a photosensitive layer formed on the undercoat layer, the method comprising: forming a coat of an undercoat-layer coating liquid which contains metal oxide particles and a compound represented by the above formula (1); and heating and drying the coat to form the undercoat layer.

In addition, the present invention relates to a process cartridge which integrally supports the above electrophotographic photosensitive member and at least one unit selected from the group consisting of a charging unit, a developing unit, a transferring unit, and a cleaning unit and which is detachable to a main body of an electrophotographic apparatus.

In addition, the present invention relates to an electrophotographic apparatus including: the above electrophotographic photosensitive member; and a charging unit, an exposure unit, a developing unit, and a transferring unit.

Advantageous Effects of Invention

According to the present invention, an electrophotographic photosensitive member which suppresses the change in potential when used for a short period of time even after a long-term repetitive use thereof under a high-temperature and high-humidity environment and a manufacturing method of the above electrophotographic photosensitive member are provided. In addition, according to the present invention, a process cartridge and an electrophotographic apparatus, each of which includes the above electrophotographic photosensitive member, are provided.

BRIEF DESCRIPTION OF DRAWINGS

FIG. 1 is a schematic view showing one example of the structure of an electrophotographic apparatus including a process cartridge which has an electrophotographic photosensitive member.

DESCRIPTION OF EMBODIMENTS

According to the present invention, an undercoat layer of an electrophotographic photosensitive member contains metal oxide particles and a compound represented by the following formula (1).

(1)

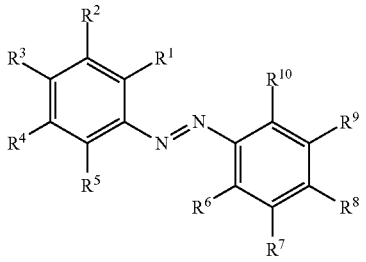

(In the formula (1), $R^1$ to $R^{10}$ each independently represents a hydrogen atom, a methyl group, an ethyl group, a n-propyl group, an isopropyl group, a cyclohexyl group, a carboxyl group, a hydroxy group, or an atomic group necessary for forming a cyclohexane ring together with $R^n$ and $R^{n+1}$. At least one of $R^1$ to $R^{10}$ is a carboxyl group or a hydroxy group. In addition, n represents an integer from 1 to 9.)

When the compound represented by the formula (1) is contained in the undercoat layer, after a long-term repetitive use of the electrophotographic photosensitive member, the change in potential thereof in a short-term use is improved, and the reason for this is construed by the present inventors as described below.

That is, the present inventors construed that by an interaction between the compound represented by the formula (1) and the surfaces of the metal oxide particles, an intramolecular charge transfer complex is formed, and hence, the state in which electrons are easily received is formed. For example, it is construed that electrons from a photosensitive layer (charge generation layer) are made to be smoothly received, and by drawing electrons from the metal oxide particles, transfer of electrons between the metal oxide particles is made smooth, so that the retention of electrical charge is suppressed.

Hereinafter, although particular examples of the compound represented by the formula (1) are shown, the present invention is not limited thereto.

(1-1)
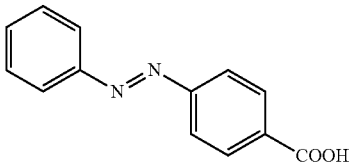
(1-2)
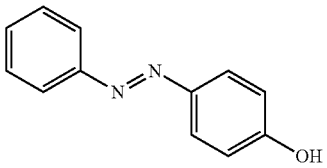
(1-3)
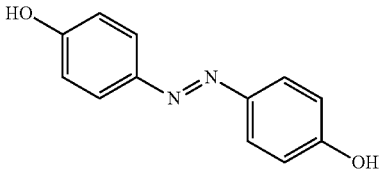
(1-4)
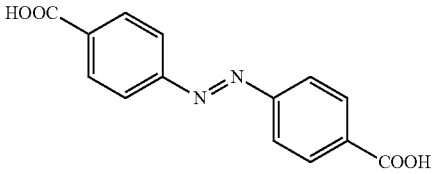
(1-5)
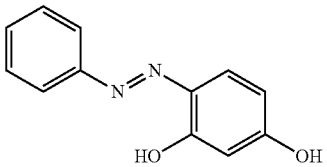
(1-6)
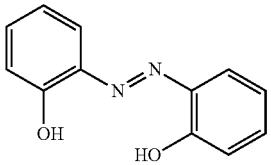
(1-7)
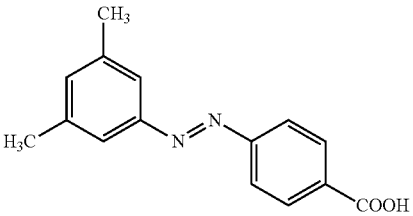
(1-8)
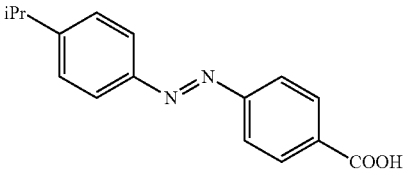
-continued
(1-9)
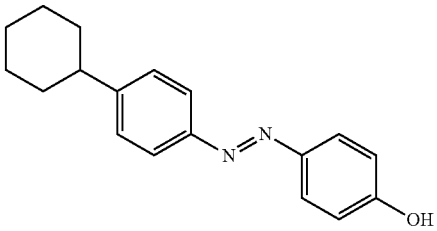
(1-10)
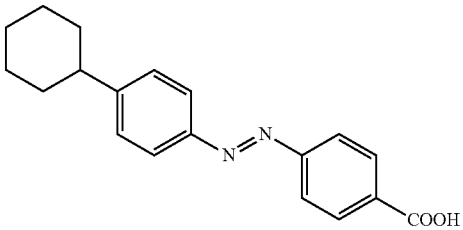
(1-11)
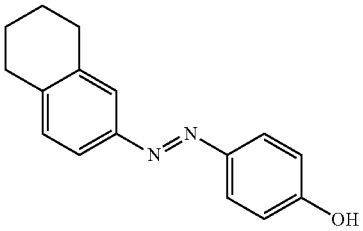
(1-12)
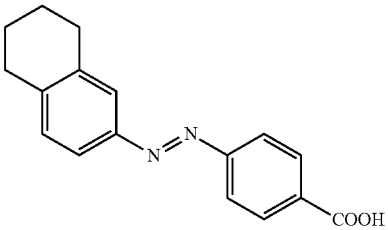
(1-13)
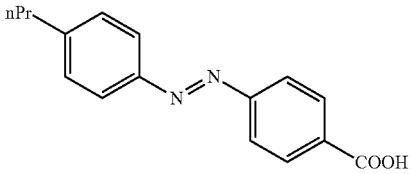
(1-14)
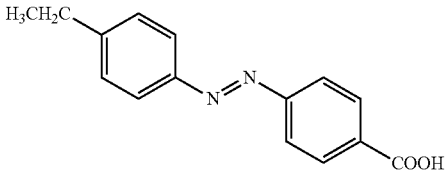
(1-15)
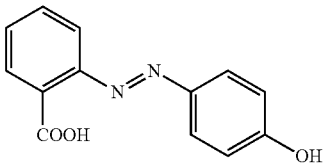

-continued (1-16)

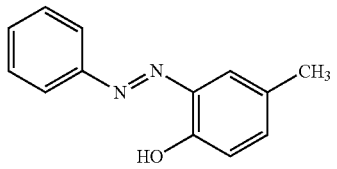

In particular, in the formula (1), when the number of groups (a carboxyl group and a hydroxyl group), each of which is interactive with the surface of the metal oxide particle, is only one (only one of $R^1$ to $R^{10}$ is a carboxyl group or a hydroxyl group), the change in potential is more preferably suppressed in the long-term repetitive use. In particular, as the example compounds, (1-1), (1-2), (1-7), (1-8), (1-9), (1-10), (1-11), (1-12), (1-13), (1-14), and (1-16) are mentioned. In addition, as the structure in which the change in potential in a short-term use after the long-term repetitive use is further suppressed, (1-1) and (1-2) are mentioned.

The structural formula (1-11) represents one example of the formula (1) in which $R^1$, $R^4$ to $R^7$, $R^9$, and $R^{10}$ each represent a hydrogen atom; $R^2$ and $R^3$ collectively form an unsubstituted n-butylene group; and $R^8$ represents a hydroxy group. The structural formula (1-12) represents one example of the formula (1) in which $R^1$, $R^4$ to $R^7$, $R^9$, and $R^{10}$ each represent a hydrogen atom; as atomic groups necessary for collectively forming a cyclohexane ring, $R^2$ and $R^3$ collectively form an unsubstituted n-butylene group; and $R^8$ represents a carboxyl group.

In addition, in the present invention, the above "represents an atomic group necessary for forming a cyclohexane ring together with $R^n$ and $R^{n+1}$" indicates that "$R^n$ and $R^{n+1}$ collectively form an unsubstituted n-butylene group".

In addition, the content of the compound represented by the formula (1) in the undercoat layer is preferably in a range of 0.01 to 20 percent by mass with respect to the metal oxide particles. The content described above is more preferably in a range of 0.05 to 5 percent by mass and even more preferably in a range of 0.05 to 4 percent by mass. When the content is 0.05 percent by mass or more, an effect of suppressing the change in charging property caused by the interaction with the metal oxide particles is enhanced. When the content is 4 percent by mass or less, an interaction between the compound molecules is suppressed, and as a result, the above effect is enhanced.

In addition, in the present invention, as the metal oxide particles contained in the undercoat layer, for example, particles of titanium oxide, zinc oxide, tin oxide, zirconium oxide, and aluminum oxide may be mentioned, and at least one type selected from those metal oxide particles may be used. Among those mentioned above, titanium oxide particles, zinc oxide particles, and tin oxide particles are preferable since the change in charging property caused by the long-term repetitive use is more suppressed, and furthermore, zinc oxide particles are more preferable.

In the undercoat layer, as the content (mass ratio) of the metallic oxide particles, the metallic oxide particles/resin is preferably in a range of 2/1 to 4/1.

Furthermore, the change in potential caused by the long-term repetitive use is more suppressed when metal oxide particles processed by a surface treatment agent are used, and hence, the metal oxide particles are preferably metal oxide particles having surfaces processed by a surface treatment agent, such as a silane coupling agent.

In addition, in the present invention, as an organic resin contained in the undercoat layer, for example, there may be mentioned an acrylic resin, an allyl resin, an alkyd resin, an ethyl cellulose resin, an ethylene-acrylic acid copolymer, an epoxy resin, a casein resin, a silicone resin, a gelatin resin, a phenol resin, a butyral resin, a polyacrylate, a polyacetal, a poly(amide imide), a polyamide, a poly(ally ether), a polyimide, a polyurethane, a polyester, a polyethylene, a polycarbonate, a polystyrene, a polysulfone, a poly(vinyl alcohol), a polybutadiene, and a polypropylene. Among those mentioned above, a polyurethane is more preferable.

The electrophotographic photosensitive member of the present invention includes a support, an undercoat layer formed on the support, and a photosensitive layer formed on the undercoat layer. The photosensitive layer is preferably a laminate type photosensitive layer including a charge generation layer which contains a charge generation substance and a charge transport layer which contains a charge transport substance.

As the support, any material (conductive support) having conductivity may be used, and for example, a support made from a metal (or an alloy), such as aluminum, an aluminum alloy, or stainless steel, may be used. In addition, the metal-made support or a plastic-made support, each having a covering layer formed, for example, from aluminum, an aluminum alloy, or an indium oxide-tin oxide alloy by vacuum deposition, may also be used. In addition, there may also be used a support formed by impregnating plastic or paper with conductive particles, such as carbon black, tin oxide particles, titanium oxide particles, and/or silver particles together with an appropriate binder resin and a plastic-made support including a conductive binder resin. In addition, as the shape of the support, for example, although a cylindrical shape or a belt shape may be mentioned, a cylindrical shape is preferable.

In addition, in order to suppress an interference pattern caused by scattering of laser light, the surface of the support may be processed by a cutting treatment, a surface-roughening treatment, or an alumite treatment.

In order to suppress an interference pattern caused by scattering of laser light and to cover scratches of the support, a conductive layer may be provided between the support and the undercoat layer. The conductive layer may be formed by dispersing conductive particles, such as carbon black, with a binder resin. The thickness of the conductive layer is preferably 5 to 40 μm and in particular, is more preferably 10 to 30 μm.

Between the photosensitive layer (charge generation layer and charge transport layer) and the support or the conductive layer, the undercoat layer is provided.

In the present invention, as an undercoat-layer coating liquid of the undercoat layer, there may be used a liquid obtained by a dispersion treatment in which the metal oxide particles and the compound represented by the formula (1) are dispersed with the organic resin and a solvent. Alternatively, as the undercoat-layer coating liquid, there may also be used a liquid obtained in such a way that after a liquid dissolving the organic resin is added to a dispersion liquid obtained by a dispersion treatment in which the metal oxide particles and the compound represented by the formula (1) are dispersed with a solvent, a dispersion treatment is further performed.

The undercoat layer of the electrophotographic photosensitive member of the present invention may be formed in such a way that the undercoat-layer coating liquid formed by one of the methods described above is applied to form a coat, and the coat thus obtained is then heated and dried. As a dispersion method, for example, a method using a homogenizer, an ultrasonic dispersion machine, a ball mill, a sand mill, a roll mill, a vibration mill, an attritor, or a liquid collision type high-speed dispersion machine may be mentioned.

As the solvent used for the undercoat-layer coating liquid, for example, an alcohol, a sulfoxide, a ketone, an ether, an ester, an aliphatic halogenated hydrocarbon, and an aromatic compound may be mentioned.

In addition, in order to suppress an interference pattern and to improve a film formation property, inorganic fine particles, organic fine particles, and/or a leveling agent may also be contained in the undercoat layer. The thickness of the undercoat layer is preferably 0.5 to 30 μm and in particular, is more preferably 10 to 30 μm.

As the charge generation substance in the charge generation layer, for example, there may be mentioned an azo pigment, a phthalocyanine pigment, an indigo pigment, a perylene pigment, a polycyclic quinone pigment, a squarylium dye, a pyrylium salt, a thiapyrylium salt, a triphenylmethane dye, a quinacridone pigment, an azlenium salt pigment, a cyanine dye, an anthanthrone pigment, a pyranthrone pigment, a xanthene dye, a quinoneimine dye, and a styryl dye. Those charge generation substances may be used alone, or at least two types thereof may be used in combination.

In addition, among those charge generation substances, in view of the sensitivity, a phthalocyanine pigment and an azo pigment are preferable, and in particular, a phthalocyanine pigment is more preferable.

In addition, in the phthalocyanine pigment, in particular, an oxititanium phthalocyanine, a chlorogallium phthalocyanine, or a hydroxygallium phthalocyanine exhibits a superior charge generation efficiency.

Furthermore, in the hydroxygallium phthalocyanine, in view of the potential characteristics, a hydroxygallium phthalocyanine crystal having peaks at Bragg angles 2θ of 7.4°±0.3° and 28.2°±0.3° in CuKα characteristic X-ray diffraction is more preferable.

As a binder resin used for the charge generation layer, for example, there may be mentioned an acrylic resin, an allyl resin, an alkyd resin, an epoxy resin, a diallyl phthalate resin, a styrene-butadiene copolymer, a butyral resin, a benzal resin, a polyacrylate, a polyacetal, a poly(amide imide), a polyamide, a poly(allyl ether), a polyarylate, a polyimide, a polyurethane, a polyester, a polyethylene, a polycarbonate, a polystyrene, a polysulfone, a poly(vinyl acetal), a polybutadiene, a polypropylene, a methacrylic resin, a urea resin, a vinyl chloride-vinyl acetate copolymer, a vinyl acetate resin, and a vinyl chloride resin. Among those mentioned above, in particular, a butyral resin is preferable. Those binder resins mentioned above may be used alone or may be used as at least one component of a mixture or a copolymer.

The charge generation layer may be formed in such a way that a charge generation-layer coating liquid which is obtained by performing a dispersion treatment on the charge generation substance together with the binder resin and a solvent is applied to form a coat, and the coat thus obtained is then heated and dried. As a dispersion method, for example, a method using a homogenizer, an ultrasonic dispersion machine, a ball mill, a sand mill, a roll mill, a vibration mill, an attritor, or a liquid collision type high-speed dispersion machine may be mentioned. The ratio of the charge generation substance and the binder resin is preferably in a range of 0.3:1 to 10:1 on a mass ratio.

As the solvent used for the charge generation-layer coating liquid, for example, an alcohol, a sulfoxide, a ketone, an ether, an ester, an aliphatic halogenated hydrocarbon, and an aromatic compound may be mentioned. The thickness of the charge generation layer is preferably 5 μm or less and in particular, is more preferably in a range of 0.1 to 2 μm. In addition, to the charge generation layer, various additives, such as a sensitizer, an antioxidant, a UV absorber, and a plasticizer, may be added if needed.

As the charge transport substance, for example, a triarylamine compound, a hydrazone compound, a styryl compound, a stilbene compound, and a butadiene compound may be mentioned. Among those mentioned above, in view of high charge mobility, a triarylamine is preferable.

As a binder resin used for the charge transport layer, for example, there may be mentioned an acrylic resin, an acrylonitrile resin, an allyl resin, an alkyd resin, an epoxy resin, a silicone resin, a phenol resin, a phenoxy resin, a polyacrylamide, a poly(amide imide), a polyamide, a poly(allyl ether), a polyarylate, a polyimide, a polyurethane, a polyester, a polyethylene, a polycarbonate, a polysulfone, a poly(phenylene oxide), a polybutadiene, a polypropylene, and a methacrylic resin. In particular, a polyarylate and a polycarbonate are preferable. Those binder resins mentioned above may be used alone or may be used as at least one component of a mixture or a copolymer.

The charge transport layer may be formed in such a way that a charge transport-layer coating liquid which is obtained by dissolving the charge transport substance and the binder resin in a solvent is applied to form a coat, and the coat thus obtained is then dried. The ratio of the charge transport substance and the binder resin is preferably in a range of 0.3:1 to 10:1 on a mass ratio. In addition, in order to suppress the generation of cracks, the drying temperature is preferably in a range of 60° C. to 150° C. and in particular, is more preferably in a range of 80° C. to 120° C. In addition, the drying time is preferably in a range of 10 to 60 minutes.

As the solvent used for the charge transport-layer coating liquid, for example, there may be mentioned an alcohol (in particular, an alcohol having at least three carbon atoms), such as propanol or butanol, an aromatic hydrocarbon, such as anisole, toluene, xylene, or chlorobenzene, methyl cyclohexane, or ethyl cyclohexane.

In addition, when the charge transport layer is configured to have a laminate structure, in order to increase the mechanical strength of the electrophotographic photosensitive member, a charge transport layer located at a surface side of the electrophotographic photosensitive member is preferably a layer obtained by curing a charge transport substance having a chain polymerizable functional group through polymerization and/or cross-linkage thereof.

As the chain polymerizable functional group, for example, an acrylic group, a methacrylic group, an alkoxy silyl group, and an epoxy group may be mentioned. In order to polymerize and/or cross-link the charge transport substance having a chain polymerizable functional group, for example, heat, light, and radiation (such as electron beams) may be used.

When the charge transport layer of the electrophotographic photosensitive member is formed from one layer, the thickness of the charge transport layer is preferably in a range of 5 to 40 μm and in particular, is more preferably in a range of 8 to 30 μm.

When the charge transport layer is configured to have a laminate structure, the thickness of a charge transport layer located at a support side of the electrophotographic photosensitive member is preferably in a range of 5 to 30 μm, and the thickness of the charge transport layer located at the surface side of the electrophotographic photosensitive member is preferably in a range of 1 to 10 μm.

In addition, to the charge transport layer, an antioxidant, a UV absorber, a plasticizer, and the like may also be added if needed.

A protective layer protecting the photosensitive layer may be provided thereon. The protective layer may be formed in such a way that a protective-layer coating liquid which is obtained by dissolving at least one of the binder resins mentioned above in a solvent is applied and is then dried. Alternatively, the protective layer may also be formed in such a way that a protective-layer coating liquid which is obtained by dissolving a resin monomer or a resin oligomer in a solvent is applied and is then cured and/or dried. For the curing, for example, light, heat, or radiation (such as electron beams) may be used.

The thickness of the protective layer is preferably in a range of 0.5 to 10 μm and particularly preferably in a range of 1 to 7 μm. In addition, for example, conductive particles may also be added to the protective layer if needed.

When the coating liquid for each layer is applied, a coating method, such as a dipping application method (dipping coating method), a spray coating method, a spinner coating method, a roller coating method, a mayer bar coating method, or a blade coating method, may be used.

In addition, in the outermost surface layer (surface layer) of the electrophotographic photosensitive member, a lubricant agent, such as a silicone oil, a wax, polytetrafluoroethylene particles, silica particles, alumina particles, or boron nitride, may be contained.

FIG. 1 shows a schematic structure of an electrophotographic apparatus including a process cartridge which has the electrophotographic photosensitive member of the present invention.

In FIG. 1, a cylindrical electrophotographic photosensitive member 1 of the present invention is rotatably driven around a shaft 2 in an arrow direction (clockwise direction) at a predetermined circumferential velocity (process speed). The surface of the electrophotographic photosensitive member 1 is uniformly charged at a positive or a negative predetermined potential in a rotation process by a charging unit 3 (primary charging unit: charging roller or the like). Next, the surface of the electrophotographic photosensitive member 1 receives exposure light 4 which is light reflected from a manuscript, which is outputted from an exposure unit (not shown), such as slit exposure or laser beam scanning exposure, and which is intensity-modified in accordance with a time-series electrical digital image signal of target image information. Accordingly, on the surface of the electrophotographic photosensitive member 1, an electrostatic latent image in accordance with the target image information is sequentially formed.

The electrostatic latent image formed on the surface of the electrophotographic photosensitive member 1 is then developed with charged particles (toner) contained in a developing agent in a developing unit 5 by normal or reversal development, so that a toner image is formed. Next, the toner image formed and carried on the surface of the electrophotographic photosensitive member 1 is sequentially transferred to a transfer medium P by a transferring bias from a transferring unit 6 (such as a transfer roller). In this case, the transfer medium P is taken out of a transfer medium feeding unit (not shown) in synchronous with the rotation of the electrophotographic photosensitive member 1 and is then fed to a portion (contact portion) between the electrophotographic photosensitive member 1 and the transferring unit 6. In addition, a bias voltage having a polarity opposite to that of the charge of the toner is applied to the transferring unit 6 from a bias power source (not shown).

The transfer medium P (in the case of a final transfer medium (such as paper or film) to which the toner image is transferred is separated from the surface of the electrophotographic photosensitive member and is then conveyed to a fixing unit 8, so that the toner image is processed by a fixing treatment. Subsequently, the transfer medium P is printed out of the apparatus as an image forming material (such as printed matter or copy). When the transfer medium P is an intermediate transfer medium, a fixing treatment is performed thereon after a plurality of transfer steps is performed, and the transfer medium P is then printed out.

The surface of the electrophotographic photosensitive member 1 after the toner image is transferred therefrom is cleaned by removing attached materials, such as a residual developing agent (residual toner) remaining after the transfer, using a cleaning unit 7 (such as a cleaning blade). In recent years, since a cleanerless system has also been studied, the residual toner remaining after the transfer may be directly recovered, for example, by a developing device. Furthermore, after being discharged by pre-exposure light (not shown) emitted from a pre-exposure unit (not shown), the surface of the electrophotographic photosensitive member 1 is repeatedly used for image formation. In addition, as shown in FIG. 1, when the charging unit 3 is a contact charging unit using a charging roller or the like, the pre-exposure may not be always necessary.

In the present invention, among the constituent elements, such as the electrophotographic photosensitive member 1, the charging unit 3, the developing unit 5, and the cleaning unit 7, a plurality thereof may be received in a container and may be integrally combined with each other to form a process cartridge. In addition, this process cartridge may be configured so as to be detachable to a main body of the electrophotographic apparatus, such as a copying machine or a laser printer. For example, when at least one of the charging unit 3, the developing unit 5, and the cleaning unit 7 is integrally supported with the electrophotographic photosensitive member 1 to form a cartridge, a process cartridge 9 detachable to the main body of the apparatus using a guide unit 10, such as a rail, thereof may be formed.

When the electrophotographic apparatus is a copying machine or a printer, the exposure light 4 is a light reflected from or transmitted through a manuscript. Alternatively, the exposure light 4 is light irradiated by a scan of laser beams, a drive of an LED array, or a drive of a liquid crystal shutter array, which is performed in accordance with signals formed through reading of a manuscript by a sensor.

EXAMPLES

Hereinafter, the present invention will be described in more detail with reference to particular examples. However, the present invention is not limited to those described below. In addition, "part(s)" in Examples indicates "part(s) by mass".

Example 1

As a support (conductive support), an aluminum cylinder having a diameter of 30 mm and a length of 357.5 mm was used.

Next, after 100 parts of the following zinc oxide particles as metal oxide particles and 500 parts of toluene were mixed together by stirring, 1.2 parts of the following silane coupling agent as a surface treatment agent was added to the above mixture, and then stirring was performed for 1 hour.

zinc oxide particles (specific surface area: 19 $m^2/g$, powder resistivity: $4.7\times10^6$ Ω·cm)

silane coupling agent (compound name: N-2-(aminoethyl)-3-aminopropyl methyl dimethoxy silane, trade name: KBM-602, manufactured by Shin-Etsu Chemical Co., Ltd.)

Subsequently, after toluene was removed by reduced-pressure distillation, heating and drying were performed at a temperature of 130° C. for 6 hours, thereby obtaining surface-treated zinc oxide particles.

Next, 15 parts of the following butyral resin functioning as a polyol resin and 15 parts of the following blocked isocyanate were dissolved in a mixed solution of 73.5 parts of methyl ethyl ketone and 73.5 parts of 1-butanol.

butyral resin (trade name: BM-1, manufactured by Sekisui Chemical Co., Ltd.)

blocked isocyanate (trade name: Sumidur 3175, manufactured by Sumitomo Bayer Urethane Co., Ltd.)

To this solution thus prepared, 80.8 parts of the above surface-treated zinc oxide particles and 0.81 parts of the compound represented by the above formula (1-1) (manufactured by Tokyo Chemical Industry Co., Ltd.) were added, and this mixture thus prepared was dispersed in a temperature atmosphere of 23° C.±3° C. for 3 hours by a sand mill machine using glass beads having a diameter of 0.8 mm.

After the dispersing was performed, the glass beads were separated, and 0.01 parts of the following silicone oil and 5.6 parts of the following melamine resin fine particles were added and stirred, so that an undercoat-layer coating liquid was prepared.

silicone oil (trade name: SH28PA, manufactured by Dow Corning Toray Co., Ltd.)

melamine resin fine particles (trade name: Optobeads 3500M, manufactured by Nissan Chemical Industries, Ltd., average primary particle diameter: 3.5 μm)

This undercoat-layer coating liquid was applied to the above support by dipping application to form a coat, and the coat thus obtained was dried at a temperature of 160° C. for 40 minutes, thereby forming an undercoat layer containing the compound represented by the formula (1-1), the zinc oxide particles, and a polyurethane resin and having a film thickness of 18 μm.

Next, 4 parts of a hydroxygallium phthalocyanine crystal (charge generation substance) having strong peaks at Bragg angles 2θ±0.2° of 7.4° and 28.1° in CuKα characteristic X-ray diffraction and 0.04 parts of a compound represented by the following formula (A) were added to a solution in which 2 parts of a poly(vinyl butyral) (trade name: S-LEC BX-1, manufactured by Sekisui Chemical Co., Ltd.) was dissolved in 100 parts of cyclohexane.

(A)

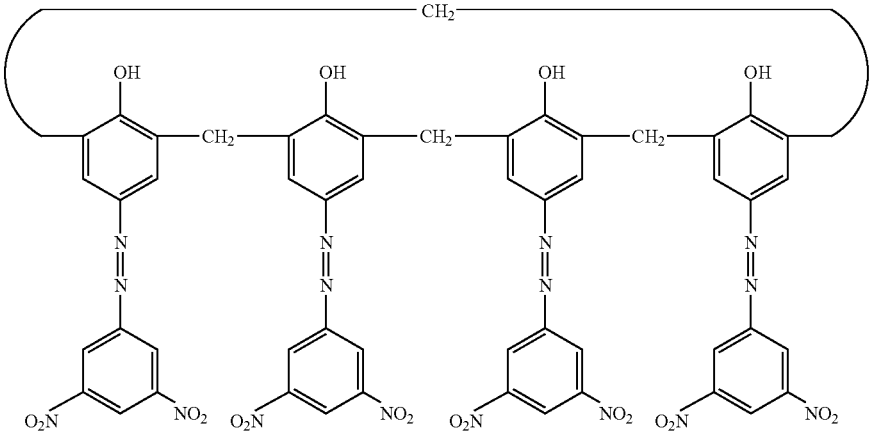

Subsequently, after a dispersion treatment was performed in an atmosphere at a temperature of 23° C.±3° C. for 1 hour by a sand mill using glass beads having a diameter of 1 mm, 100 parts of ethyl acetate was added, so that a charge generation-layer coating liquid was prepared. This charge generation-layer coating liquid was applied on the undercoat layer by dipping application, and a coat thus obtained was dried at 90° C. for 10 minutes, so that a charge generation layer having a film thickness of 0.21 μm was formed.

Next, 50 parts of an amine compound represented by the following formula (B), 50 parts of an amine compound represented by the following formula (C), and 100 parts of the following polycarbonate were dissolved in a mixed solvent containing 650 parts of chlorobenzene and 150 parts of methylal. As described above, a coating liquid for a charge transport layer (first charge transport layer) was prepared.

polycarbonate (trade name: Iupilon Z400, manufactured by Mitsubishi Gas Chemical Company Inc.)

(B)

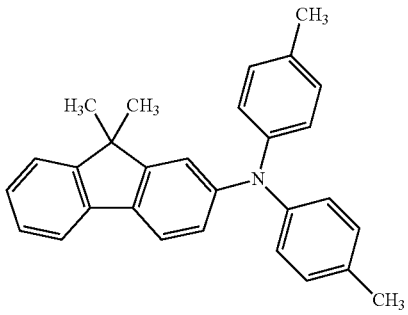

-continued (C)

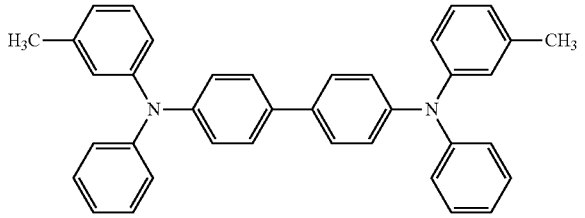

After being homogenized, this charge transport-layer coating liquid was left to stand for one day and was then applied on the charge generation layer by dipping application, and a coat thus obtained was dried at a temperature of 110° C. for 60 minutes, so that a charge transport layer (first charge transport layer) having a film thickness of 18 μm was formed.

Next, 45 parts of a compound (charge transport substance (hole transport compound) having an acrylic group functioning as a chain polymerizable functional group) represented by the following formula (D) and 55 parts of n-propanol were dispersed and mixed together by an ultra-high pressure dispersing machine, so that a coating liquid for a surface layer (second charge transport layer) was prepared.

(D)

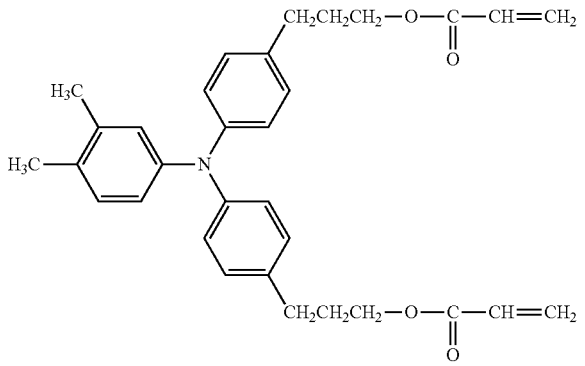

After this surface-layer coating liquid was applied on the first charge transport layer by dipping application, and a coat thus obtained was dried at a temperature of 50° C. for 5 minutes, the coat was cured by irradiation with electron beams at an acceleration voltage of 60 kV and an absorption dose of 8,000 Gy. Subsequently, the coat was heat-treated for 3 minutes under the condition in which the temperature thereof reached 120° C. From the irradiation of electron beams to the heat treatment performed for 3 minutes, the oxygen concentration was 20 ppm. Next, in the air, a heat treatment was performed for 30 minutes under the condition in which the temperature of the coat reached 100° C., so that a surface layer (second charge transport layer) having a film thickness of 5 μm was formed.

As described above, an electrophotographic photosensitive member having the support, the undercoat layer, the charge generation layer, the charge transport layer (first charge transport layer), and the surface layer (second charge transport layer) in this order was formed.

Examples 2 to 17

Except that in Example 1, for example, the type and the amount of each of the compound represented by the formula (1) and the metal oxide particles, which were used for preparing the undercoat-layer coating liquid, were set as shown in Table 1, an electrophotographic photosensitive member was formed in a manner similar to that in Example 1.

Examples 18 and 19

Except that in Example 1, the amount of the surface-treated zinc oxide particles in the undercoat-layer coating liquid was changed from 80.8 parts to 120 parts, an electrophotographic photosensitive member was formed in a manner similar to that in Example 1.

Examples 20 and 21

Except that in Example 1, the amount of the surface-treated zinc oxide particles in the undercoat-layer coating liquid was changed from 80.8 parts to 130 parts, an electrophotographic photosensitive member was formed in a manner similar to that in Example 1.

Comparative Example 1

Except that in Example 1, the compound represented by the above formula (1-1) was not used for the undercoat layer, and that when the charge generation-layer coating liquid was formed, 0.04 parts of the above formula (1-5) was added, and a dispersion treatment was then performed, an electrophotographic photosensitive member was formed in a manner similar to that in Example 1.

Comparative Example 2

Except that in Example 1, the compound represented by the above formula (1-1) was changed to a compound represented by the following formula (E) (manufactured by Tokyo Chemical Industry Co., Ltd.), an electrophotographic photosensitive member was formed in a manner similar to that in Example 1.

(E)

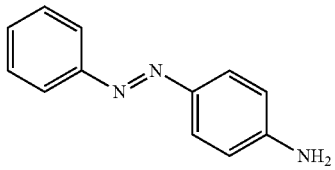

Comparative Example 3

Except that in Example 1, the compound represented by the above formula (1-1) was changed to a compound represented by the following formula (F) (manufactured by Tokyo Chemical Industry Co., Ltd.), an electrophotographic photosensitive member was formed in a manner similar to that in Example 1.

(F)

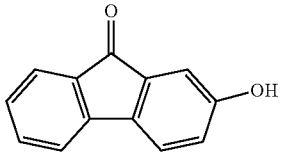

Comparative Example 4

Except that in Example 1, the compound represented by the above formula (1-1) was changed to a compound represented by the following formula (G) (manufactured by Tokyo Chemical Industry Co., Ltd.), an electrophotographic photosensitive member was formed in a manner similar to that in Example 1.

(G)

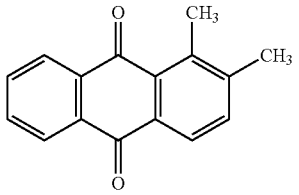

(Evaluation)

An evaluation method of the electrophotographic photosensitive member of each of Examples 1 to 17 and Comparative Examples 1 to 4 is as follows.

<Change in Potential>

As an evaluation apparatus, a copying machine manufactured by CANON KABUSHIKI KAISHA (trade name: GP405, process speed: 210 mm/sec; (primary) charging unit: rubber roller type contact charging (charging roller) in which an alternating current was superimposed with a direct current; exposure unit: laser image exposure; developing unit: single-component magnetic negative toner non-contact developing system; transferring unit: roller type contact transferring system; cleaning unit: cleaner having a rubber blade provided in a counter direction; and pre-exposure unit: pre-exposure using a fuse lamp) was used. The electrophotographic photosensitive members of Examples 1 to 17 and Comparative Examples 1 to 4 were each installed in this evaluation machine.

The above evaluation apparatus was installed in an environment at a temperature of 30° C. and a relative humidity of 80%. When the alternating-current component of the charging roller was set to be 1,500 Vpp and 1500 Hz and the direct-current component thereof was set to be −850 V, an initial dark potential (Vda) before a long-term repetitive use test and an initial light potential (Vla) before a long-term repetitive use test obtained by exposure of laser irradiation at 780 nm were each adjusted to be −200 V in each of the electrophotographic photosensitive members.

The surface potential of the electrophotographic photosensitive member was measured in such a way that a developing cartridge was pulled out of the evaluation apparatus, and a potential measurement device was inserted into a position from which the developing cartridge was pulled out. The potential measurement device is configured so that a potential measurement probe was disposed at a developing position of the developing cartridge, and the position of the potential measurement probe with respect to the electrophotographic photosensitive member was at the center of the cylindrical electrophotographic photosensitive member in its axis direction, and the gap from the surface thereof was set to 3 mm.

Next, the evaluation was performed in accordance with the following procedures (1) and (2). In this case, without changing the alternating-current component/direct-current component and the exposure condition of each of the electrophotographic photosensitive members, which were set at the initial stage, the evaluation was performed in accordance with the following procedures (1) and (2). In addition, in order to enable the electrophotographic photosensitive member to adapt to the conditions at a temperature of 30° C. and a relative humidity of 80%, the electrophotographic photosensitive member was left to stand under the above conditions for 48 hours, and the evaluation was then performed.

(1) The electrophotographic photosensitive member and the potential measurement device were installed in the above evaluation apparatus, and the following potentials were then measured.

Initial dark potential (Vda) before the long-term repetitive use test

Initial light potential (Vla) before the long-term repetitive use test

Next, prior to the long-term repetitive use test, a short-term repetitive use test was performed in which printing was performed on 999 sheets without passing sheets, and the following potentials were then measured.

Dark potential (Vdb) at a 999-th sheet before the long-term repetitive use test

Light potential (Vlb) at a 999-th sheet before the long-term repetitive use test In addition, the following amount of change in each of the dark potential and the light potential was calculated, so that a dark potential change amount ΔVd (ab) before the long-term repetitive use test and a light potential change amount ΔVl (ab) before the long-term repetitive use test were obtained.

Initial dark potential (Vda) before the long-term repetitive use test-Dark potential (Vdb) at a 999-th sheet before the long-term repetitive use test=Dark potential change amount ΔVd (ab) before the long-term repetitive use test Initial light potential (Vla) before the long-term repetitive use test-Light potential (Vlb) at a 999-th sheet before the long-term repetitive use test=Light potential change amount ΔVl (ab) before the long-term repetitive use test (2) Subsequently, after the potential measurement device was removed, and the developing cartridge was then installed, the long-term repetitive use test was performed by passing 50,000 sheets. After the long-term repetitive use test was completed, the apparatus was left to stand under the same conditions (temperature: 30° C., and relative humidity: 80%) for 24 hours. After the apparatus was left for 24 hours, the potential measurement device was installed after the developing cartridge was removed, and the following potentials were measured.

Initial dark potential (Vdc) after the long-term repetitive use test

Initial light potential (Vlc) after the long-term repetitive use test

Next, a short-term repetitive use test in which printing was performed on 999 sheets without passing the sheets was performed after the long-term repetitive use test, and the following potentials were measured.

Dark potential (Vdd) at a 999-th sheet after the long-term repetitive use test

Light potential (Vld) at a 999-th sheet after the long-term repetitive use test

In addition, the following change amount of each of the dark potential and the light potential was calculated, so that a dark potential change amount ΔVd (cd) after the long-term repetitive use test and a light potential change amount ΔVl (cd) after the long-term repetitive use test were obtained.

Initial dark potential (Vdc) after the long-term repetitive use test-Dark potential (Vdd) at a 999-th sheet after the long-term repetitive use test=Dark potential change amount ΔVd (cd) after the long-term repetitive use test Initial light potential (Vlc) after the long-term repetitive use test-Light potential (Vld) at a 999-th sheet after the long-term repetitive use test=Light potential change amount ΔVl (cd) after the long-term repetitive use test In addition, a sequence for the 50,000-sheet repetitive use test (long-term repetitive use test) was performed using A4-size paper at a printing percentage of 6% in an intermittent mode (8 seconds per sheet) in which printing is stopped every sheet.

TABLE 1

| | Compound No. | Addition Amount of Compound/% | Metal Oxide Particles | Surface Treatment Agent | Before Long-Term Repetitive Use Test ΔVd(ab) | ΔVl(ab) | After Long-Term Repetitive Use Test Vdc | Vlc | ΔVd(cd) | ΔVl(cd) |
|---|---|---|---|---|---|---|---|---|---|---|
| Example 1 | 1-1 | 1 | Zinc Oxide Particles | KBM602 | −10 | +10 | 840 | 210 | −5 | +10 |
| Example 2 | 1-2 | 1 | Zinc Oxide Particles | KBM602 | −10 | +10 | 840 | 215 | −10 | +15 |
| Example 3 | 1-1 | 1 | Zinc Oxide Particles | KBM603 | −10 | +15 | 840 | 220 | −10 | +15 |
| Example 4 | 1-1 | 1 | Zinc Oxide Particles | — | −15 | +15 | 830 | 220 | −15 | +20 |
| Example 5 | 1-1 | 1 | Titanium Oxide Particles | — | −20 | +20 | 830 | 225 | −15 | +20 |
| Example 6 | 1-1 | 1 | Tin Oxide Particles | — | −20 | +20 | 830 | 225 | −15 | +20 |
| Example 7 | 1-1 | 1 | Aluminum Oxide Particles | — | −20 | +25 | 820 | 225 | −15 | +25 |
| Example 8 | 1-1 | 0.05 | Zinc Oxide Particles | KBM602 | −10 | +10 | 840 | 220 | −10 | +15 |
| Example 9 | 1-1 | 4 | Zinc Oxide Particles | KBM602 | −10 | +10 | 840 | 220 | −10 | +15 |
| Example 10 | 1-1 | 5 | Zinc Oxide Particles | KBM602 | −15 | +20 | 840 | 220 | −10 | +20 |
| Example 11 | 1-2 | 5 | Zinc Oxide Particles | KBM602 | −15 | +20 | 840 | 225 | −15 | +20 |
| Example 12 | 1-5 | 0.04 | Zinc Oxide Particles | KBM602 | −15 | +25 | 820 | 235 | −20 | +25 |
| Example 13 | 1-5 | 5 | Zinc Oxide Particles | KBM602 | −15 | +25 | 820 | 235 | −20 | +25 |
| Example 14 | 1-15 | 0.04 | Zinc Oxide Particles | KBM602 | −15 | +20 | 820 | 230 | −15 | +25 |
| Example 15 | 1-15 | 5 | Zinc Oxide Particles | KBM602 | −15 | +20 | 820 | 230 | −15 | +25 |
| Example 16 | 1-16 | 0.04 | Zinc Oxide Particles | KBM602 | −15 | +20 | 820 | 225 | −15 | +25 |
| Example 17 | 1-16 | 5 | Zinc Oxide Particles | KBM602 | −15 | +20 | 820 | 225 | −15 | +25 |
| Example 18 | 1-1 | 1 | Zinc Oxide Particles | KBM602 | −10 | +10 | 840 | 210 | −5 | +10 |
| Example 19 | 1-2 | 1 | Zinc Oxide Particles | KBM602 | −10 | +10 | 840 | 210 | −5 | +10 |
| Example 20 | 1-1 | 1 | Zinc Oxide Particles | KBM602 | −10 | +10 | 840 | 215 | −10 | +15 |
| Example 21 | 1-2 | 1 | Zinc Oxide Particles | KBM602 | −10 | +10 | 840 | 215 | −10 | +15 |
| Comparative Example 1 | — | | Zinc Oxide Particles | KBM602 | −90 | +100 | 680 | 300 | −160 | +120 |
| Comparative Example 2 | E | 1 | Zinc Oxide Particles | KBM602 | −110 | +120 | 750 | 290 | −100 | +80 |
| Comparative Example 3 | F | 1 | Zinc Oxide Particles | KBM602 | −15 | +15 | 750 | 270 | −60 | +70 |
| Comparative Example 4 | G | 1 | Zinc Oxide Particles | KBM602 | −20 | +20 | 700 | 350 | −150 | +100 |

In addition, as the compounds (1-2), (1-15) and (1-16), compounds manufactured by Tokyo Chemical Co., Ltd., were used, and as the compound (1-5), a compound manufactured by Wako Pure Chemical Industries, Ltd. was used.

As the metal oxide particles, the following were used.

Titanium oxide particles: trade name: TKP-101, manufactured by Tayca Corporation, crystalline particle diameter: 6 nm.

Tin oxide particles: trade name: Nanotek $SnO_2$, manufactured by C. I. Kasei Company, Ltd., crystalline particle diameter: 21 nm.

Aluminum oxide particles: trade name: Nanotek $Al_2O_3$, manufactured by C. I. Kasei Company, Ltd., crystalline particle diameter: 21 nm.

In addition, KBM-603 used as a surface treatment agent was a silane coupling agent (compound name: N-2-(aminoethyl)-3-aminopropyl trimethoxy silane) manufactured by Shin-Etsu Chemical Co., Ltd.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-086148, filed Apr. 16, 2013, which is hereby incorporated by reference herein in its entirety.

The invention claimed is:

1. An electrophotographic photosensitive member comprising:

a support;

an undercoat layer formed on the support; and a photosensitive layer formed on the undercoat layer, wherein the undercoat layer comprise:

metal oxide particles; and a compound represented by the following formula (1), (1)

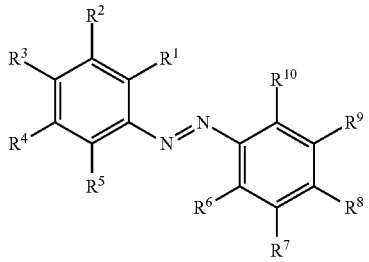

wherein $R^1$ to $R^{10}$ each independently represents a hydrogen atom, a methyl group, an ethyl group, a n-propyl group, an isopropyl group, a cyclohexyl group, a carboxyl group, a hydroxy group, or an atomic group necessary for forming a cyclohexane ring together with $R^n$ and $R^{n+1}$, n represents an integer from 1 to 9, and at least one of $R^1$ to $R^{10}$ is a carboxyl group or a hydroxy group.

2. The electrophotographic photosensitive member according to claim 1, wherein in the formula (1), only one of $R^1$ to $R^{10}$ represents a carboxyl group or a hydroxy group.

3. The electrophotographic photosensitive member according to claim 1, wherein the compound represented by the formula (1) is a compound represented by the following formula (1-1) or a compound represented by the following formula (1-2)

(1-1)

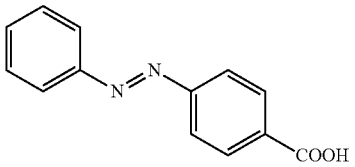

(1-2)

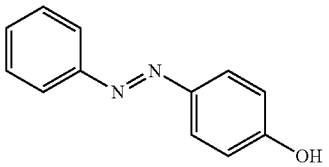

4. The electrophotographic photosensitive member according to claim 1, wherein the content of the compound represented by the formula (1) in the undercoat layer is in a range of 0.05 to 4 percent by mass with respect to the metal oxide particles.

5. The electrophotographic photosensitive member according to claim 1, wherein the metal oxide particles are particles which comprise at least one selected from the group consisting of titanium oxide, zinc oxide, and tin oxide.

6. The electrophotographic photosensitive member according to claim 1, wherein the metal oxide particles are metal oxide particles whose surfaces have been treated with a silane coupling agent.

7. A process cartridge which integrally supports the electrophotographic photosensitive member according to claim 1 and at least one unit selected from the group consisting of a charging unit, a developing unit, a transferring unit, and a cleaning unit and which is detachable to a main body of an electrophotographic apparatus.

8. An electrophotographic apparatus comprising:

the electrophotographic photosensitive member according to claim 1; and a charging unit, an exposure unit, a developing unit, and a transferring unit.

9. A method for manufacturing an electrophotographic photosensitive member which comprises a support, an undercoat layer formed on the support, and a photosensitive layer formed on the undercoat layer, the method comprising:

forming a coat of an undercoat-layer coating liquid which comprises metal oxide particles and a compound represented by the following formula (1); and heating and drying the coat to form the undercoat layer:

(1)

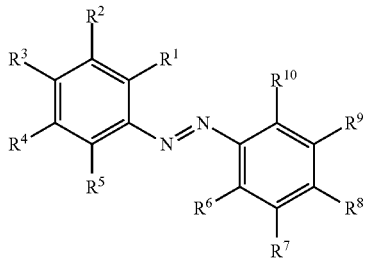

where in the formula (1), $R^1$ to $R^{10}$ each independently represents a hydrogen atom, a methyl group, an ethyl group, a n-propyl group, an isopropyl group, a cyclohexyl group, a carboxyl group, a hydroxy group, or an atomic group necessary for forming a cyclohexane ring together with $R^n$ and $R^{n+1}$, n represents an integer from 1 to 9, and at least one of $R^1$ to $R^{10}$ is a carboxyl group or a hydroxy group.

10. The method for manufacturing an electrophotographic photosensitive member according to claim 9, wherein in the formula (1), only one of $R^1$ to $R^{10}$ represents a carboxyl group or a hydroxy group.

11. The method for manufacturing an electrophotographic photosensitive member according to claim 9, wherein the compound represented by the formula (1) is a compound represented by the following formula (1-1) or a compound represented by the following formula (1-2)

(1-1)

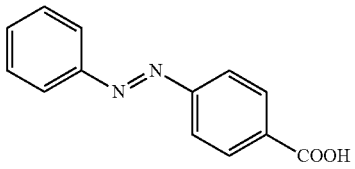

(1-2)

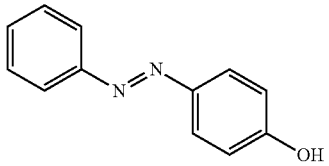

12. The method for manufacturing an electrophotographic photosensitive member according to claim 9, wherein the content of the compound represented by the formula (1) in the undercoat layer is in a range of 0.05 to 4 percent by mass with respect to the metal oxide particles.

13. The method for manufacturing an electrophotographic photosensitive member according to claim 9, wherein the metal oxide particles are particles which comprise at least one selected from the group consisting of titanium oxide, zinc oxide, and tin oxide.

14. The method for manufacturing an electrophotographic photosensitive member according to claim 9, wherein the metal oxide particles are metal oxide particles whose surfaces have been treated with a silane coupling agent.

* * * * *